US005254815A

United States Patent [19]

Nakano et al.

[11] Patent Number: 5,254,815

[45] Date of Patent: Oct. 19, 1993

[54] RESERVOIR TANK INCLUDING FLOAT WITH REED SWITCH UNIT

[75] Inventors: Toshihiro Nakano, Chiryu; Shinji Sakata, Nishio, both of Japan

[73] Assignee: Aisin Seiki Kabushiki Kaisha, Kariya, Japan

[21] Appl. No.: 873,199

[22] Filed: Apr. 24, 1992

[30] Foreign Application Priority Data

Apr. 26, 1991 [JP] Japan ..... 03-97079

[51] Int. Cl.[5] ..... H01H 35/18

[52] U.S. Cl. ..... 200/84 C; 200/51 R

[58] Field of Search ..... 307/118; 200/61.2, 51 R, 200/84 RC; 73/49.2, 307, 308, 313; 340/623, 624; 335/205

[56] References Cited

U.S. PATENT DOCUMENTS

| | | | |
|---|---|---|---|
| 4,305,285 | 12/1981 | Kubota | 73/308 |
| 4,356,729 | 11/1982 | Kubota | 73/308 |
| 4,841,107 | 6/1989 | Tandler | 200/84 C |
| 4,843,193 | 6/1989 | Budecker | 200/84 C |
| 4,926,015 | 5/1990 | Takahashi et al. . | |

FOREIGN PATENT DOCUMENTS

| | | |
|---|---|---|
| 0184687 | 6/1986 | European Pat. Off. . |
| 62-5415 | 2/1987 | Japan . |
| 1136234 | 12/1968 | United Kingdom . |
| 2053570 | 2/1981 | United Kingdom . |
| 2178238 | 2/1987 | United Kingdom . |
| 2204997 | 11/1988 | United Kingdom . |
| 2222309 | 2/1990 | United Kingdom . |

*Primary Examiner*—Gerald P. Tolin

*Attorney, Agent, or Firm*—Oblon, Spivak, McClelland, Maier & Neustadt

[57] ABSTRACT

A reservoir tank according to the present invention is comprised of a tank body storing an amount of operating fluid, connected to a specific device for supplying thereinto the operating fluid and having a bottom with a hole isolated from the operating fluid; a float movable in the vertical direction according to the variation of the liquid level of the operating fluid; a magnet secured to a lower end of the float; and a reed switch unit assembly having a reed switch with a pair of terminals, a pair of conducting elements connected to the pair of terminals of the reed switch, a connector casing, and a pair of connectors each of which is secured to one end of the connector casing in such a manner that each connector is electrically connected to the respective conducting element.

11 Claims, 2 Drawing Sheets

RESERVOIR TANK INCLUDING FLOAT WITH REED SWITCH UNIT

BACKGROUND OF THE INVENTION

The present invention relates to a reservoir tank for storing therein an amount of operating fluid to be supplied into a device such as a brake master cylinder or a clutch release cylinder.

In a conventional reservoir tank of the type is disclosed, for example, in Japanese Utility Model Publication No. 62(1987)-5415 published after examination on Feb. 6, 1987, a reservoir tank for storing therein an amount of operating fluid has a bottom under which a hole is formed. Within the hole, a reed switch unit assembly having a reed switch is inserted which is interposed between a power supply and a lamp, both of which are connected in series. The reed switch is set to be closed by a magnet which is secured to a float on the operating fluid whenever the liquid level thereof lowered below a set value. In light of the fact that in this device the reliability thereof depends on a relative position of the reed switch to the magnet, the reed switch is accommodated in a casing in such manner that the reed switch is located in place by pawl means formed in the casing and is fixed by an amount of epoxy resin filled in the casing.

However, in light of the fact the need for forming of pawl means in the casing and the filling the epoxy resin thereinto, it is cumbersome to constitute the foregoing reed switch unit assembly. In addition, the size of the casing must be larger than that of the reed switch, which is contrary to the recent light-weight requirement for an automotive component.

SUMMARY OF THE INVENTION

It is, therefore, an object of the invention to provide a reservoir tank without the above conventional drawbacks.

It is another object of the invention to provide a reservoir tank in which a reed switch unit assembly is simple in structure.

It is further object of the invention to provide a reservoir tank in which a reed switch unit assembly is simple to manufacture.

In order to attain the foregoing objects, a reservoir tank according to the present invention is comprised of a tank body storing an amount of operating fluid, connected to a specific device for supplying thereinto the operating fluid and having a bottom with a hole isolated from the operating fluid; a float movable in the vertical direction according to the variation of the liquid level of the operating fluid; a magnet secured to a lower end of the float; and a reed switch unit assembly having a reed switch with a pair of terminals, a pair of conducting elements connected to the pair of terminals of the reed switch, a connector casing, and a pair of connectors each of which is secured to one end of the connector casing in such a manner that each connector is electrically connected to the respective conducting element.

BRIEF DESCRIPTION OF THE DRAWINGS

The above and other objects, features and advantages of the present invention will be more apparent and more readily appreciated from the following detailed description of preferred exemplarily embodiments of the present invention, taken in connection with the accompanying drawings, in which.

DESCRIPTION OF THE PREFERRED EMBODIMENT

Figure 1:
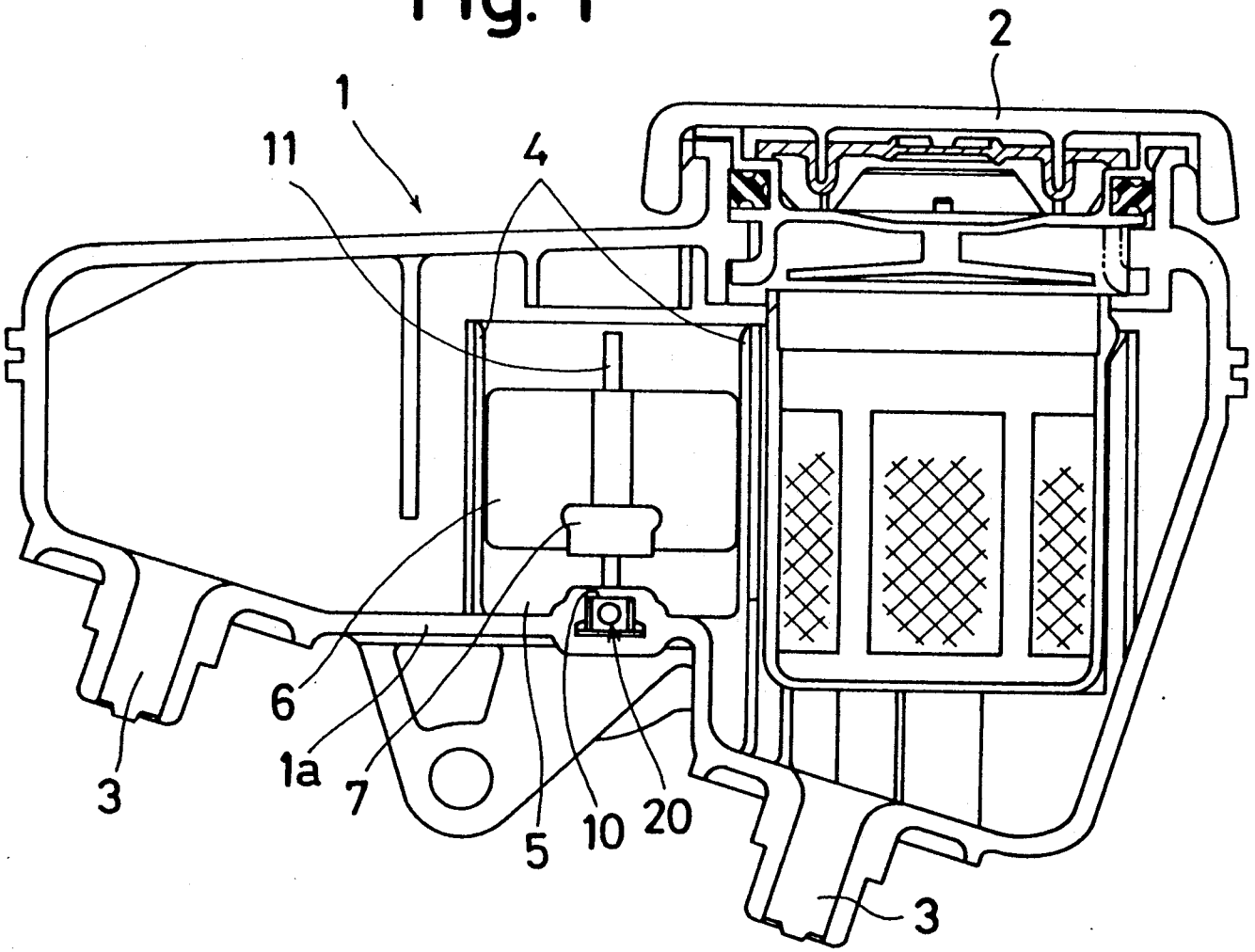
FIG. 1 is a cross-sectional view of a reservoir tank according to the present invention.
Figure 2:
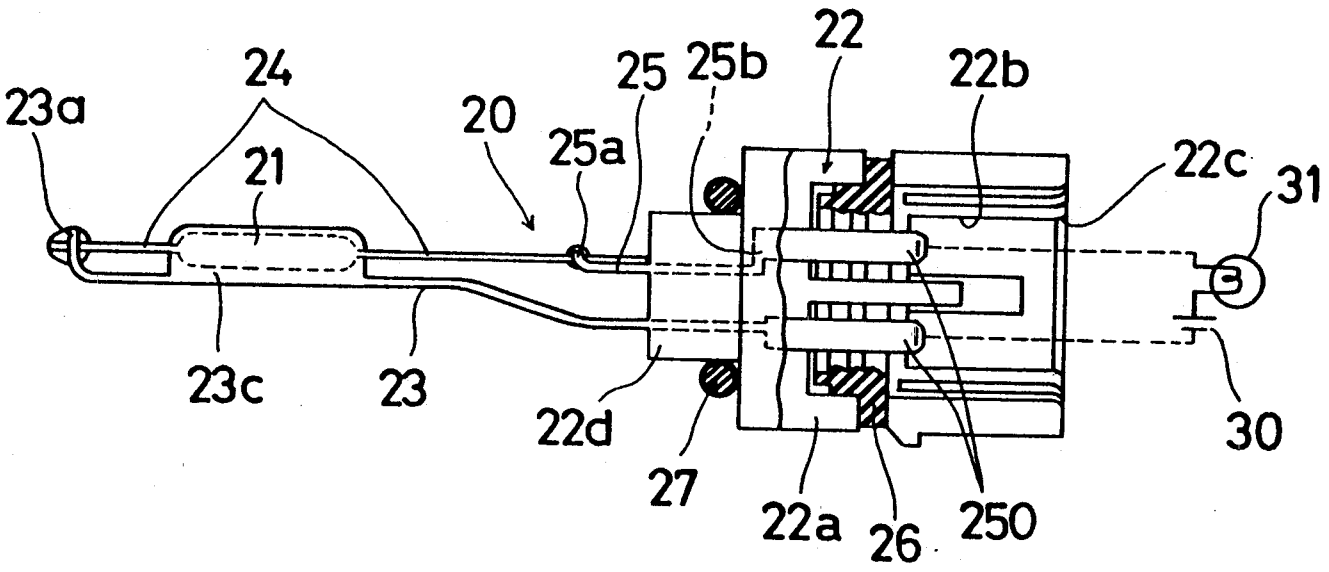
FIG. 2 is a side view with a partial cross-section of a reed switch unit assembly.

Referring to FIGS. 1 and 2, a reservoir tank 1 in which an amount of operating fluid is stored includes a pair of spaced connecting holes 3 and 3, each of which is in the form of an extension or a projection to be connected to a respective hole (not shown) of a master cylinder (not shown). It is to be noted that the reservoir tank 1 can be connected to a similar apparatus such as a clutch release cylinder. Thus, the operating fluid is set to be supplied into the master cylinder. The reservoir tank 1 has an opening at its upper end portion, which is detachably mounted with a cap 2 made of an elastic material such as a rubber.

Within the reservoir tank 1, a fluid chamber 5 is defined which is surrounded by a pair of walls of the tank 1 and a pair partitions 4 and 4. In the fluid chamber 5, a float 6 which is provided at its lower end Portion with a magnet 7 is accommodated so as to be guided or moved along a shaft 11 in accordance with the liquid level of the operating fluid which is upstanding from a bottom la of the reservoir tank 1.

Below the bottom 1*a* of the reservoir tank 1, there is formed a hole 10 whose axis is pendicular to that of the shaft 11. In the hole 10, reed switch unit assembly 20 is set to be accommodated which has a reed switch 21 to be closed when a magnetic force from the magnet 7 exceeds a set value as a result of the lowering movement thereof.

As best shown in FIG. 2, the reed switch unit assembly 20 has a connector casing 22 made of a synthetic resin. The connector casing 22 includes a main body 22*a* provided at its right end portion with a cavity 22*b* with an opening 22*c*. A pair of parallely spaced connectors 250 each of which is secured at its left end to the main body 22*a* of connector casing 22, and its right end of each connectors 250 is positioned with in the cavity 22*b* so as to be oriented toward the opening 22*c*. A sub body 22*d* is formed integrally with a left end of the main body 22*a*. The main body 22*a* and the sub body 22*d* have a common axis and the radius of the former is larger than that of the latter. Between the connectors 250, a power supply 30 and a warning lamp 31 which are connected in series are interposed.

A first conducting element 23 is secured at its right end to the sub body 22*d* so as to be electrically connected to one of the connectors 25. The first conducting element 23 is extended away from the sub body 22*d* and terminated in an upwardly 90-degree distal bent portion 23*a*. A second conducting element 25 is secured at its right end to the sub body 22*d* so as to be electrically connected to the other connector 250. The second conducting element 25 is extended away from the sub body 22*d* and the left end or distal end 25*a* of the second conducting element 25 is brought into opposition to the distal end 23*a* of the first conducting element 23 at a distance. The reed switch 21 with a pair of terminals 24 and 24, each of which is in the form of a wire, is located between the distal end 23*a* of the first conducting element 23 and the distal end 25*a* of the second conducting element 25 and the terminals 24 and 24 of the reed switch 21 are electrically connected to the distal end of the first conducting element 23 and the distal end 25*a* of the second conducting element 25 means of soldering. A pair of walls 23*c* and 23*c* (only One is shown) are extended integrally in the upward direction from the first conducting element 23 in such a manner the reed switch 21 is to be located therebetween. In other words, a cross-section of the resulting portion is a substantially U-shaped configuration which accommodating the reed switch 21. The walls 23*c* and 23*c* are used for Protecting longitudinal sides of the reed switch 21.

It is to be noted that the electrical connection between a right end of the second conducting element 25 and the other connector 250 is in the form of the eccentric connection 25*b* in order to prevent effecting the reed switch 21 even if an unexpected pulling force acts to the other connector 250. An O-ring 27 mounted on the sub body 22*b* adjacent to the main body 22*a* serves for the fluid-tight seal between the hole 10 and the connector casing 22. A grommet 26 is provided to the connector casing 22 for the water-proof sealing thereof.

In the illustrated condition, though the reed switch 21 is rested on the first conducting element 23, the reed switch 21 can be spaced away from the first conducting element 23 by reinforcing the strength of each terminal 24 of the reed switch 21.

The connection between one connector 250 and the first conducting element 23 (between the other connector 250 and the second conducting element 25) is established during the molding formation of the connector casing 22.

In the present invention, the conducting elements 23 and 25 are used for the positioning of the reed switch 21, which ensures a simple structure of the reed switch unit assembly 20. Therefore, so long as the assurance of the precise size of the connector casing 22, the relative position between the magnet 7 and the reed switch 21 after the installation of the reed switch unit assembly 20 in the bottom la of the reservoir tank 1 is a substantially stable, which assures the reliability of the function of the reed switch unit assembly 20.

Obviously, many modifications and variations of the present invention are possible in light of the above teachings. It is, therefore, to be understood that within the scope of the appended claims, the invention may be practiced otherwise than as specifically described.

What is claimed is:

1. A reservoir tank comprising:

a tank body storing an amount of operating fluid, connected to a specific device for supplying thereinto the operating fluid and having a bottom with a hole isolated from the operating fluid;

a float movable in said tank body in the vertical direction according to the variation of the liquid level of the operating fluid;

a magnet secured to a lower end of the float;

a reed switch unit assembly in said isolated hole and having a casing, a first connector secured to one end of the casing, a second connector secured to the one end of the casing, a first conducting element secured to the other end of the casing so as to be electrically connected therein to the first connector and having a distal end extending away from the casing, a reed switch positioned between the distal ends of the first and the second conducting elements and having opposite terminals electrically connected thereto; and a pair of walls formed integrally with the first conducting element between which the reed switch is positioned.

2. A reservoir tank in accordance with claim 1, wherein the connection between the second conducting element and the second connector is established via an eccentric part.

3. A reservoir tank in accordance with claim 1, wherein the distal ends of the first and the second conducting elements are opposed with each other on a common line.

4. A reservoir tank in accordance with claim 1, wherein each of the terminals of the reed switch is in the form of a wire.

5. A reservoir tank in accordance with claim 1, wherein the reed switch is rested on the first conducting element.

6. A reservoir tank in accordance with claim 1, wherein the terminals of the reed switch are soldered to the distal ends of the first and the second conducting elements.

7. A reservoir tank in accordance with claim 1, wherein the casing is formed into a steped configuration.

8. A liquid reservoir in which a permanent magnet mounted on a float is movable to a position in proximity to a reed switch to indicate a low level of liquid in the reservoir, wherein the reed switch is incorporated in a reed switch assembly which comprises a casing detachably secured to the reservoir and positioned in a hole sealed from the reservoir, a pair of electrical connector terminals connected to the casing, a pair of independent cantilever type electrical conductors extending from the casing, wherein each of the conductors is connected to a respective one of the electrical connector terminals, and wherein the reed switch is connected between and supported only by the electrical conductors.

9. A liquid reservoir comprising:

a tank body having separate bottom hole;

a float having a magnet and vertically movably mounted in said tank body; and a reed switch assembly mounted in said tank body at a position such that the float moves to a position in proximity to a reed switch element of said reed switch assembly when a liquid level in the tank body is low, said reed switch assembly comprising:

a) a casing detachably secured to the reservoir so as to be positioned at the hole, b) a pair of electrical connector terminals mounted in the casing and extending therefrom, c) a pair of cantilever conductors electrically connected to said connector terminals and having distal ends extending from said casing and into said hole; and d) a reed switch element having switch terminals respectively connected to said distal ends of said cantilever conductors, said cantilever conductors supporting said reed switch element and providing electrical connection between said reed switch element and said connector terminals, wherein said reed switch element is supported only by said cantilever conductors.

10. The liquid reservoir of claim 9, wherein one of said cantilever conductors further comprises a pair of walls between which said reed switch element is positioned.

11. The liquid reservoir of claim 9 including a stepped connection between at least one of said connector terminals and a corresponding one of said cantilever conductors.

* * * * *